US011612983B2

(12) United States Patent
Sotozaki et al.

(10) Patent No.: US 11,612,983 B2
(45) **Date of Patent: *Mar. 28, 2023**

(54) POLISHING APPARATUS AND POLISHING METHOD

(71) Applicant: EBARA CORPORATION, Tokyo (JP)

(72) Inventors: Hiroshi Sotozaki, Tokyo (JP); Tadakazu Sone, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 75 days.

This patent is subject to a terminal disclaimer.

(21) Appl. No.: 17/233,115

(22) Filed: Apr. 16, 2021

(65) Prior Publication Data

US 2021/0229240 A1 Jul. 29, 2021

Related U.S. Application Data

(63) Continuation of application No. 15/950,070, filed on Apr. 10, 2018, now Pat. No. 11,007,621.

(30) Foreign Application Priority Data

Apr. 11, 2017 (JP) ..... JP2017-078060

(51) Int. Cl.
*B24B 57/02* (2006.01)
*B24B 55/12* (2006.01)
(Continued)

(52) U.S. Cl.
CPC ..... *B24B 57/02* (2013.01); *B24B 37/015* (2013.01); *B24B 37/042* (2013.01);
(Continued)

(58) Field of Classification Search
CPC ... B24B 37/015; B24B 37/042; B24B 37/107; B24B 49/14; B24B 55/02; B24B 55/12; B24B 57/02
(Continued)

(56) References Cited

U.S. PATENT DOCUMENTS 5,127,196 A * 7/1992 Morimoto ..... B24B 55/02 257/E21.244
5,664,990 A * 9/1997 Adams ..... B24B 55/03 451/36
(Continued)

FOREIGN PATENT DOCUMENTS

JP H08-294861 A 11/1996
JP 2006-088292 A 4/2006
JP 2013-099828 A 5/2013

*Primary Examiner* — Eileen P Morgan
(74) *Attorney, Agent, or Firm* — BakerHostetler

(57) ABSTRACT

Provided is a polishing apparatus and polishing method which can preferably adjust a temperature of a surface of a polishing pad. A polishing apparatus includes: a polishing table configured to be rotatable, and to support the polishing pad; a substrate configured to hold an object to be polished, and to press the object to be polished against the polishing pad; a polishing liquid supplying portion configured to supply a polishing liquid to a polishing surface; a polishing liquid removing portion configured to remove the polishing liquid from the polishing surface; and a temperature adjuster configured to adjust a temperature of the polishing surface. In a rotating direction of the polishing table, the polishing liquid supplying portion, a polishing region where the object to be polished is pressed against the polishing surface by the substrate, the polishing liquid removing portion, and the temperature adjuster are disposed in this order.

9 Claims, 6 Drawing Sheets

(51) Int. Cl.

| | |
|---|---|
| ***B24B 55/02*** | (2006.01) |
| ***B24B 37/015*** | (2012.01) |
| ***B24B 49/14*** | (2006.01) |
| ***B24B 37/04*** | (2012.01) |
| ***B24B 55/06*** | (2006.01) |
| ***B24B 37/10*** | (2012.01) |

(52) U.S. Cl.
CPC ..... *B24B 37/107* (2013.01); *B24B 49/14* (2013.01); *B24B 55/02* (2013.01); *B24B 55/06* (2013.01); *B24B 55/12* (2013.01)

(58) Field of Classification Search
USPC ..... 451/7, 53, 910
See application file for complete search history.

(56) References Cited

U.S. PATENT DOCUMENTS 5,775,980 A * 7/1998 Sasaki ..... B24B 37/015 451/60
6,012,967 A * 1/2000 Satake ..... B24B 57/02 451/6
6,028,006 A * 2/2000 Bawa ..... B24B 37/30 451/36
7,837,534 B2 * 11/2010 Aiyoshizawa ..... B24B 55/02 451/7
8,172,641 B2 * 5/2012 Ho ..... B24B 55/02 451/7
8,845,391 B2 * 9/2014 Sone ..... B24B 37/042 451/7
9,731,401 B2 * 8/2017 Maruyama ..... B24B 37/015
9,782,870 B2 * 10/2017 Maruyama ..... G01J 5/025
10,195,712 B2 * 2/2019 Maruyama ..... G01J 5/025
2003/0104769 A1 * 6/2003 Brunelli ..... B24B 53/017 451/28
2003/0186623 A1 * 10/2003 Pham ..... B24B 37/12 451/7
2005/0221724 A1 10/2005 Terada et al.
2007/0135020 A1 * 6/2007 Nabeya ..... B24B 37/015 451/7
2008/0311823 A1 * 12/2008 Aiyoshizawa ..... B24B 55/02 451/7
2010/0203806 A1 * 8/2010 Kitakura ..... B24B 37/015 451/6
2011/0081832 A1 * 4/2011 Nakamura ..... B24B 37/10 451/28
2011/0159782 A1 * 6/2011 Sone ..... B24B 37/015 451/7
2012/0220196 A1 * 8/2012 Maruyama ..... B24B 37/04 451/7
2014/0273753 A1 * 9/2014 Matsuo ..... B24B 37/005 451/6
2015/0231760 A1 * 8/2015 Maruyama ..... B24B 49/14 451/7
2017/0232572 A1 * 8/2017 Brown ..... B24B 37/107 451/5
2017/0355059 A1 * 12/2017 Benner ..... H01L 21/6708
2020/0001427 A1 * 1/2020 Soundararajan ..... B24B 37/015

* cited by examiner

POLISHING APPARATUS AND POLISHING METHOD

TECHNICAL FIELD

The present invention relates to a polishing apparatus and a polishing method.

BACKGROUND ART

There is an increasing importance for a technique for planarizing a surface of a semiconductor device in manufacturing steps for semiconductor devices. Chemical Mechanical Polishing (CMP) is known as a technique for planarization. In the Chemical Mechanical Polishing, polishing is performed using a polishing apparatus where a polishing liquid (slurry) containing abrasive grains such as silica ($SiO_2$) or cerium oxide ($CeO_2$) is supplied to a polishing pad as a substrate such as a semiconductor wafer is brought into slide contact with the polishing pad thus performing polishing of the substrate.

The polishing apparatus which performs the CMP process includes a polishing table which supports the polishing pad, and a substrate holding mechanism. The substrate holding mechanism is provided for holding the substrate, and is referred to as a top ring, a polishing head or the like. In the polishing apparatus, the polishing liquid is supplied to the polishing pad from a polishing liquid supply nozzle, and the substrate is pressed against a surface (polishing surface) of the polishing pad at a predetermined pressure. At this time, the polishing table and the substrate holding mechanism are rotated so that the substrate is brought into slide contact with the polishing surface whereby a surface of the substrate is polished into a planarized and mirror-finished surface.

A polishing rate for the substrate is not only dependent on a polishing load of a substrate against the polishing pad but also dependent on a temperature of the surface of the polishing pad. This is because the chemical effect of the polishing liquid on the substrate is dependent on a temperature. Further, depending on a substrate to be manufactured, it is desired to perform a CMP process at a low temperature so as to prevent loss of quality. Accordingly, with respect to the polishing apparatus, it is important to maintain a temperature of the surface of the polishing pad at an optimal value during polishing of the substrate. Accordingly, recently, a polishing apparatus is proposed which includes a temperature adjusting mechanism which adjusts a temperature of a surface of a polishing pad.

CITATION LIST

Patent Literature

PTL 1: Japanese Patent Laid-Open No. 2013-99828

SUMMARY OF INVENTION

Technical Problem

As examples of methods for adjusting a temperature of a surface of a polishing pad during polishing of the substrate, techniques considered include a technique of injecting a gas toward the surface of the polishing pad, and a technique of disposing a heat exchanger in the vicinity of the surface of the polishing pad. However, when such temperature adjusting mechanisms are used, the polishing liquid on the polishing pad functions as a heat-insulating layer. Accordingly, there are cases where efficiency of adjusting a temperature of the surface of the polishing pad is lowered. Particularly, when a gas is injected toward the surface of the polishing pad, there is a problem that a mist of a polishing liquid is scattered around. When the polishing liquid adheres to a surface of a component in the polishing apparatus and dries, there is a possibility of the polishing liquid becoming a powder and falling on the surface of the polishing pad. Such powder fall becomes a cause of the formation of scratches on the surface of the substrate.

The present invention has been made under the above-mentioned circumstances, and it is an object of the present invention to provide a polishing apparatus and a polishing method which can preferably adjust a temperature of a surface of a polishing pad. It is another object of the present invention to provide a polishing apparatus and a polishing method which can reduce scattering of a polishing liquid on the polishing pad.

Solution to Problem

[Aspect 1] According to aspect 1, a polishing apparatus is proposed which performs polishing of an object to be polished using a polishing pad having a polishing surface. The polishing apparatus includes: a polishing table configured to be rotatable, and to support the polishing pad; a holder configured to hold the object to be polished, and to press the object to be polished against the polishing pad; a polishing liquid supplying portion configured to supply a polishing liquid to the polishing surface; a polishing liquid removing portion configured to remove the polishing liquid from the polishing surface; and a temperature adjuster configured to adjust a temperature of the polishing surface. In a rotating direction of the polishing table, the polishing liquid supplying portion, a polishing region where the object to be polished is pressed against the polishing surface by the holder, the polishing liquid removing portion, and the temperature adjuster are disposed in this order. According to the aspect 1, the polishing liquid removing portion is disposed forward of the temperature adjuster in the rotating direction of the polishing table and hence, the temperature adjuster can adjust a temperature of the polishing surface in a state where the polishing liquid is removed. Accordingly, efficiency of adjusting a temperature of the polishing surface by the temperature adjuster can be enhanced.

[Aspect 2] According to aspect 2, in the polishing apparatus of the aspect 1, the temperature adjuster includes at least one of an injector which is configured to spray a gas to the polishing surface or a heat exchanger in which a fluid flows. According to the aspect 2, a temperature of the polishing surface can be adjusted by the injector and/or the heat exchanger. Further, also in the case where a gas is sprayed to the polishing surface, the gas can be sprayed to the polishing surface in a state where the polishing liquid is removed. Therefore, scattering of the polishing liquid on the polishing pad can be reduced.

[Aspect 3] According to aspect 3, in the polishing apparatus of the aspect 1 or 2, the polishing liquid removing portion includes at least one of a suction portion configured to suck the polishing liquid or a dam portion which comes into contact with the polishing liquid on the polishing surface thus preventing the polishing liquid from moving in the rotating direction. According to the aspect 3, the polishing liquid can be removed from the polishing surface by the suction portion and/or the dam portion.

[Aspect 4] According to aspect 4, in the polishing apparatus of the aspect 3, the polishing liquid removing portion includes the suction portion and the dam portion, and the dam portion is disposed rearward of the suction portion in the rotating direction, and is integrally formed with the suction portion. According to the aspect 4, the polishing liquid which is prevented from moving in the rotating direction by the dam portion can be sucked by the suction portion and hence, the polishing liquid can be preferably removed from the polishing surface.

[Aspect 5] According to aspect 5, in the polishing apparatus of any one of the aspects 1 to 4, the polishing apparatus further includes a temperature measuring portion configured to measure a temperature of the polishing surface, and the temperature adjuster is configured to adjust the temperature of the polishing surface such that the temperature measured by the temperature measuring portion reaches a target temperature. According to the aspect 5, a temperature of the polishing surface can be adjusted by the temperature adjuster based on a temperature measured by the temperature measuring portion.

[Aspect 6] According to aspect 6, a polishing method is proposed where a polishing table on which a polishing pad is mounted is rotated, and an object to be polished is pressed against the polishing pad so as to polish the object to be polished. The polishing method includes: supplying a polishing liquid to a polishing surface of the polishing pad; removing the polishing liquid from the polishing surface; and adjusting a temperature of the polishing surface. In a rotating direction of the polishing table, said supplying, pressing of the object to be polished against the polishing pad, said removing, and said adjusting are performed in this order. According to the aspect 6, substantially the same advantageous effects as the above-mentioned polishing apparatus can be acquired.

DESCRIPTION OF EMBODIMENT

Figure 1:
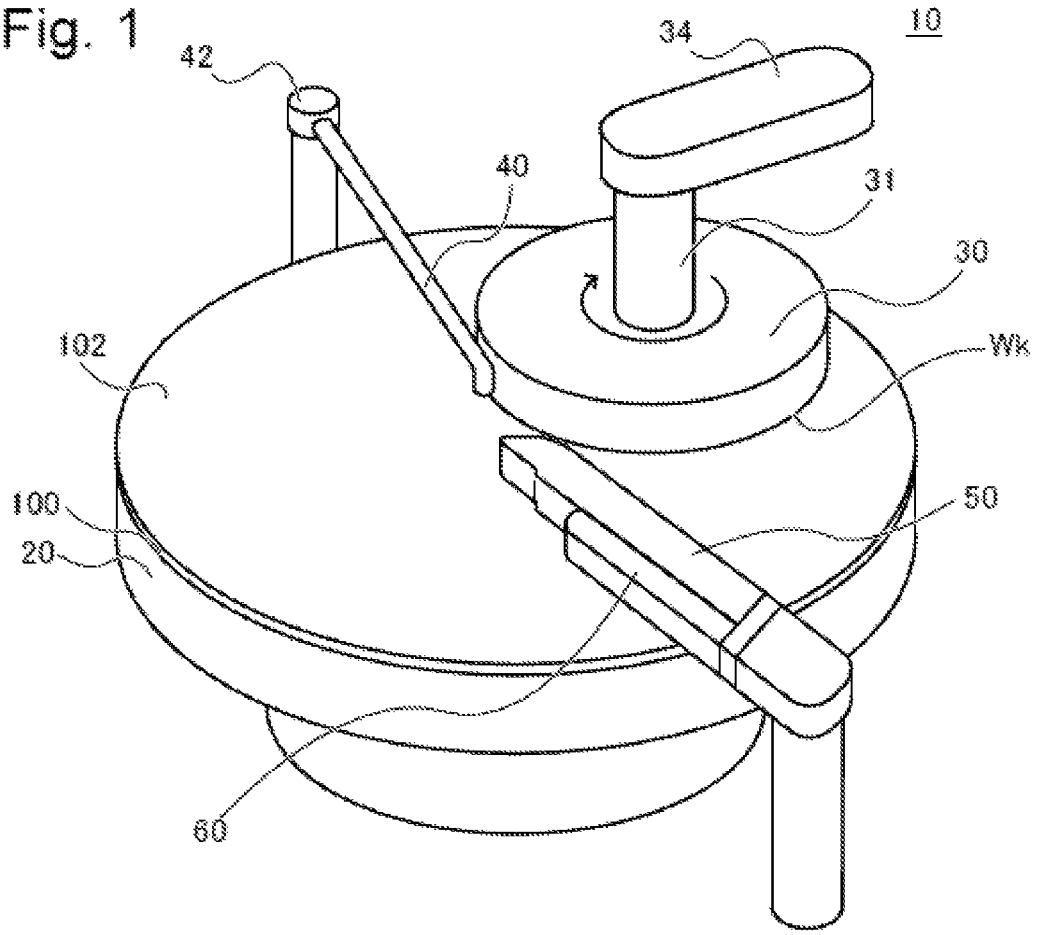
FIG. 1 is a view showing the schematic configuration of a polishing apparatus according to one embodiment of the present invention.

Hereinafter, an embodiment of the present invention is described with reference to drawings. In the drawings, identical or corresponding constitutional elements are given the same symbols, and the repeated description of such element is omitted.

FIG. 1 is a view showing the schematic configuration of a polishing apparatus according to one embodiment of the present invention. The polishing apparatus 10 of this embodiment is capable of performing polishing of a substrate Wk, such as a semiconductor wafer, which is an object to be polished using a polishing pad 100 having a polishing surface 102. As shown in the drawing, the polishing apparatus 10 includes a polishing table 20 which supports the polishing pad 100, and a top ring (holder) 30 which holds the substrate Wk and presses the substrate Wk against the polishing pad 100. The polishing apparatus 10 also includes a polishing liquid supply nozzle (polishing liquid supplying portion) 40 which supplies a polishing liquid (slurry) to the polishing pad 100.

The polishing table 20 is formed into a disk shape, and is configured to be rotatable using a central axis of the polishing table 20 as an axis of rotation. The polishing pad 100 is mounted on the polishing table 20 by adhesion or the like. A surface of the polishing pad 100 forms a polishing surface 102. The polishing pad 100 integrally rotates with the polishing table 20 with the rotation of the polishing table 20 performed by a motor not shown in the drawing.

The top ring 30 holds the substrate Wk, which is the object to be polished, on a lower surface of the top ring 30 by vacuum suction or the like. The top ring 30 is configured to be rotatable together with the substrate Wk by power from a motor not shown in the drawing. An upper portion of the top ring 30 is connected to a support arm 34 by way of a shaft 31. The top ring 30 is movable in the vertical direction by an air cylinder not shown in the drawing so that a distance between the top ring 30 and the polishing table 20 is adjustable. With such a configuration, the top ring 30 can press the held substrate Wk against the surface (polishing surface) 102 of the polishing pad 100. Further, the support arm 34 is configured to be swingable by a motor not shown in the drawing thus causing the top ring 30 to move in the direction parallel to the polishing surface 102. In this embodiment, the top ring 30 is configured to be movable between a receiving position not shown in the drawing where the top ring 30 receives the substrate Wk and a position disposed above the polishing pad 100. At the same time, the top ring 30 is configured such that a pressing position where the top ring 30 presses the substrate Wk to the polishing pad 100 can be changed. Hereinafter, a pressing position (holding position) where the top ring 30 presses the substrate Wk is also referred to as "polishing region".

The polishing liquid supply nozzle 40 is disposed above the polishing table 20, and supplies a polishing liquid (slurry) to the polishing pad 100 supported by the polishing table 20. The polishing liquid supply nozzle 40 is supported by a shaft 42. The shaft 42 is configured to be swingable by a motor not shown in the drawing so that the polishing liquid supply nozzle 40 can change the position where the polishing liquid supply nozzle 40 drips the polishing liquid during polishing.

Figure 4:
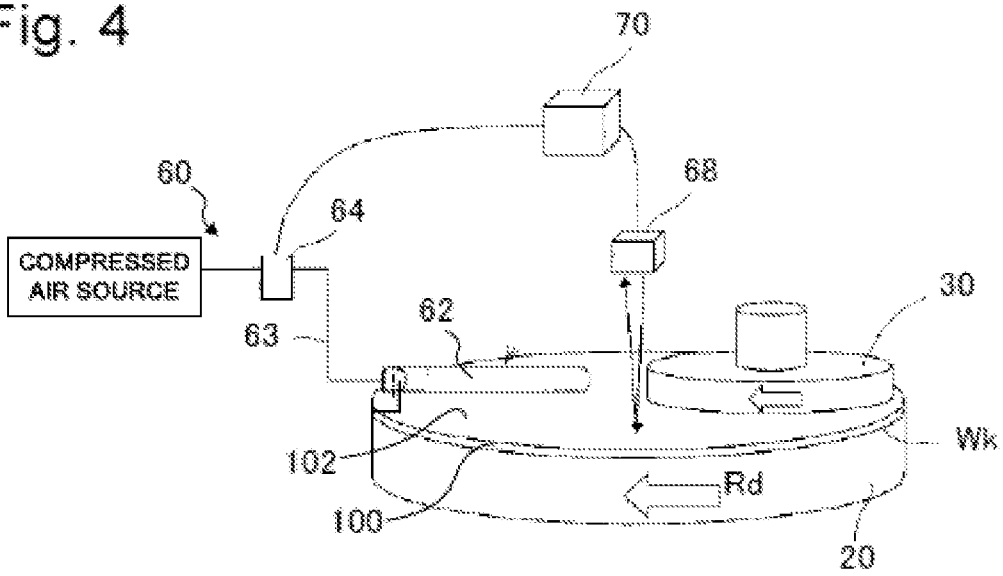
FIG. 4 is a view for describing the manner of the control of a temperature adjuster which is performed by a controller.

The polishing apparatus 10 also includes a controller 70 which controls operation of the entire polishing apparatus 10 (see FIG. 4). The controller 70 may be formed of a microcomputer which includes a CPU, a memory and the like, and realizes a desired function using software. Alternatively, the controller 70 may be formed of hardware circuit which performs a dedicated calculation operation.

In the polishing apparatus 10, polishing of the substrate Wk is performed as follows. First, the top ring 30 holding the substrate Wk on the lower surface thereof is rotated and, at the same time, the polishing pad 100 is rotated. In this state, the polishing liquid is supplied from the polishing liquid supply nozzle 40 to the polishing surface 102 of the polishing pad 100, and the substrate Wk held by the top ring 30 is pressed against the polishing surface 102. Accordingly, in a state where a surface of the substrate Wk is in contact with the polishing pad 100 with slurry interposed therebetween, the substrate Wk and the polishing pad 100 move in a relative manner. With such operations, the substrate Wk is polished.

Figure 2:
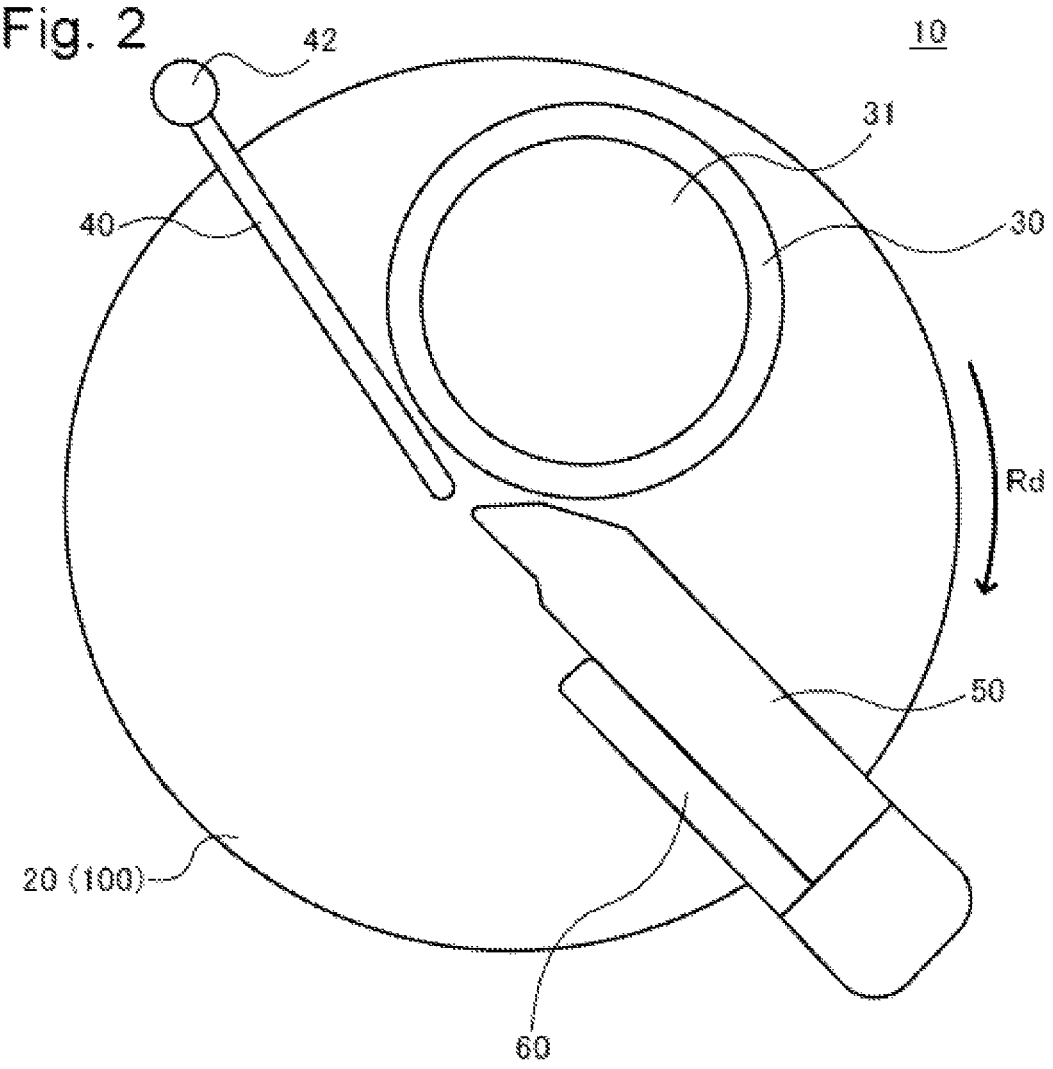
FIG. 2 is a plan view showing the arrangement relationship between respective constitutional elements of the polishing apparatus.

As shown in FIG. 1, the polishing apparatus 10 further includes a polishing liquid removing portion50 and a temperature adjuster60. FIG. 2 is a plan view showing the arrangement relationship between the respective constitutional elements of the polishing apparatus 10. As shown in FIG. 2, in the polishing apparatus 10 of this embodiment, when polishing of the substrate Wk is performed, in the rotating direction Rd of the polishing table 20, the polishing liquid supply nozzle 40, the polishing region of the substrate Wk (the position where the top ring 30 presses the substrate Wk), the polishing liquid removing portion50, and the temperature adjuster60 are disposed in this order. In this embodiment, the polishing liquid removing portion50 and the temperature adjuster60 are disposed adjacently to each other. However, the configuration is not limited to such an example, and the polishing liquid removing portion50 and the temperature adjuster60 may be disposed in a spaced-apart manner.

The polishing liquid removing portion50 is provided for removing the polishing liquid from the polishing surface 102 at a position rearward (on the downstream side) of the polishing region of the substrate Wk in the rotating direction Rd of the polishing table 20. That is, the polishing liquid removing portion50 removes a polishing liquid used once for performing polishing of the substrate Wk from the polishing surface 102. As shown in FIG. 2, the polishing liquid removing portion50 is disposed so as to extend along the radial direction of the polishing table 20.

Figure 3:
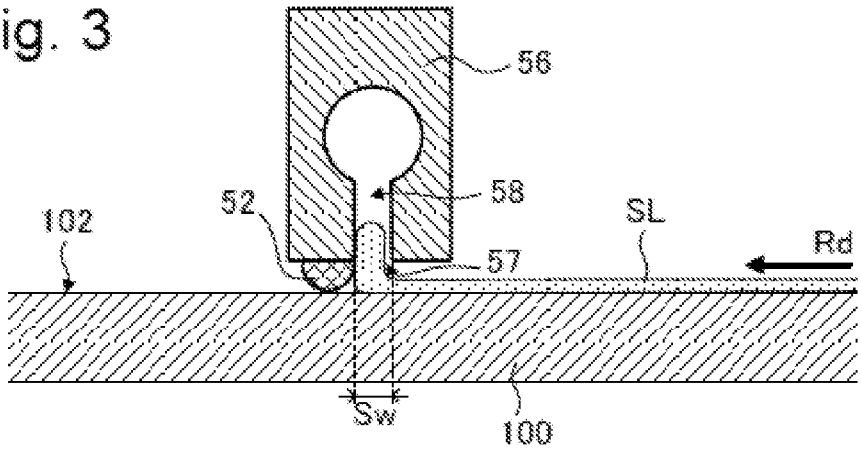
FIG. 3 is a view schematically showing one example of a polishing liquid removing portion.

FIG. 3 is a view schematically showing one example of the polishing liquid removing portion50. FIG. 3 shows a cross section of the polishing liquid removing portion50 taken along a line perpendicular to the longitudinal direction (the radial direction of the polishing table 20). As shown in FIG. 3, the polishing liquid removing portion50 in this embodiment includes a dam portion 52 which dams a polishing liquid SL on the polishing surface 102, and a suction portion 56 which sucks the polishing liquid SL. In this embodiment, the dam portion 52 and the suction portion 56 are integrally formed with each other.

The dam portion 52 comes into contact with the polishing surface 102 thus preventing the polishing liquid SL from moving in the rotating direction Rd of the polishing table 20. It is preferable to select a material for forming the dam portion 52 such that the dam portion 52 does not damage the polishing surface 102 and, at the same time, abraded debris of the dam portion 52 per se generated by contact with the polishing surface 102 does not remain on the polishing surface 102. As one example, the dam portion 52 may be made of a material equal to a material for forming a retaining ring not shown in the drawing which holds an outer peripheral edge of the substrate Wk. Alternatively, the dam portion 52 may be also made of a synthetic resin such as PPS (polyphenylene sulfide) or metal such as stainless steel. Further, resin coating of PEEK (polyether ketone), PTFE (polytetrafluoroethylene), polyvinyl chloride or the like may be applied to the surface of the dam portion 52. Moreover, as shown in FIG. 3, to reduce a contact resistance against the polishing surface 102, a portion of the dam portion 52 which comes into contact with the polishing surface 102 may be rounded (or chamfered).

The suction portion 56 is disposed forward (on the upstream side) of the dam portion 52 in an adjacent manner in the rotating direction Rd of the polishing table 20. The suction portion 56 has a slit 57 which opens toward the polishing surface 102, and the slit 57 is connected to a vacuum source not shown in the drawing through a flow passage 58. In this embodiment, the flow passage 58 extending to the vacuum source not shown in the drawing from the slit 57 makes an angle of 90 degrees with respect to the polishing surface 102. The slit 57 is preferably formed with a length shorter than a length of the dam portion 52 and longer than a diameter of the substrate Wk in the longitudinal direction of the polishing liquid removing portion50. It is sufficient for the width Sw of the slit 57 to be determined depending on a kind of polishing liquid SL, performance of the vacuum source not shown in the drawing or the like. As one example, when the diameter of the substrate Wk is 300 mm, the length of the slit 57 in the longitudinal direction is preferably set to 300 mm or more, and the width Sw of the slit 57 is preferably set to approximately 1 to 2 mm.

As described above, in the polishing liquid removing portion50 in this embodiment, the dam portion 52 which dams the polishing liquid SL is disposed rearward of the suction portion 56 which sucks the polishing liquid SL in a continuous manner in the rotating direction Rd of the polishing table 20. Accordingly, the polishing liquid SL dammed by the dam portion 52 can be sucked by the suction portion 56 and hence, the polishing liquid SL can be preferably removed from the polishing surface 102.

The polishing liquid removing portion50 is preferably separated from the polishing surface 102 when the conditioning of the polishing surface 102 is performed by an atomizer or a dresser not shown in the drawing. That is, the polishing liquid removing portion50 may be configured to be movable between a polishing liquid removing position at which the polishing liquid removing portion50 removes the polishing liquid SL and a stand-by position separated from the polishing surface 102 by a distance, and may be positioned at the stand-by position when the conditioning of the polishing surface 102 is performed. The polishing apparatus 10 of this embodiment can perform the conditioning of the polishing surface 102 in a state where the polishing liquid is removed from the polishing surface 102 by the polishing liquid removing portion50. Accordingly, it is possible to suppress the mixing of a liquid used by the atomizer or the dresser and the polishing liquid. Therefore, the used liquid generated by performing polishing of the substrate Wk and the used liquid generated by performing the conditioning of the substrate Wk can be collected respectively and hence, the technique contributes to environmental conservation.

The description returns to FIG. 1 and FIG. 2. The temperature adjuster60 is disposed rearward of the polishing liquid removing portion50 in the rotating direction Rd of the polishing table 20. The temperature adjuster60 is controlled by the controller so as to adjust a temperature of the polishing surface 102. FIG. 4 is a view for describing the manner of the control of the temperature adjuster60 performed by the controller. In FIG. 4, the illustration of the polishing liquid removing portion50 is omitted. As shown in the drawing, the temperature adjuster60 in this embodiment includes gas injection nozzles (injectors) 62 for spraying a gas to the polishing surface 102. The gas injection nozzles 62 are connected to a compressed air source by way of a compressed air supply line 63. A pressure control valve 64 is provided to the compressed air supply line 63. Compressed air supplied from the compressed air source passes through the pressure control valve 64 so that pressure and a flow rate of the compressed air are controlled. The pressure control valve 64 is connected to the controller70. Compressed air may be at a normal temperature, or may be cooled or heated to a predetermined temperature.

As shown in FIG. 4, a temperature sensor 68 which detects a temperature of the surface of the polishing pad 100 is disposed above the polishing pad 100. In this embodiment, the temperature sensor 68 is preferably disposed rearward of the polishing liquid removing portion50 in the rotating direction Rd of the polishing table 20, and detects a temperature of the polishing surface 102 in a state where the polishing liquid is removed. The temperature sensor 68 is connected to the controller70. The controller70 adjusts a valve opening of the pressure control valve 64 by performing PID control corresponding to the difference between a target temperature which is a predetermined temperature or an inputted set temperature and an actual temperature of the polishing surface 102 which is detected by the temperature sensor 68. With such adjustment, a flow rate of compressed air to be injected from each gas injection nozzle 62 is controlled. Accordingly, compressed air of an optimal flow rate is sprayed to the polishing surface 102 of the polishing pad 100 from the gas injection nozzles 62 and hence, a temperature of the polishing surface 102 is maintained at the target temperature.

Figure 5:
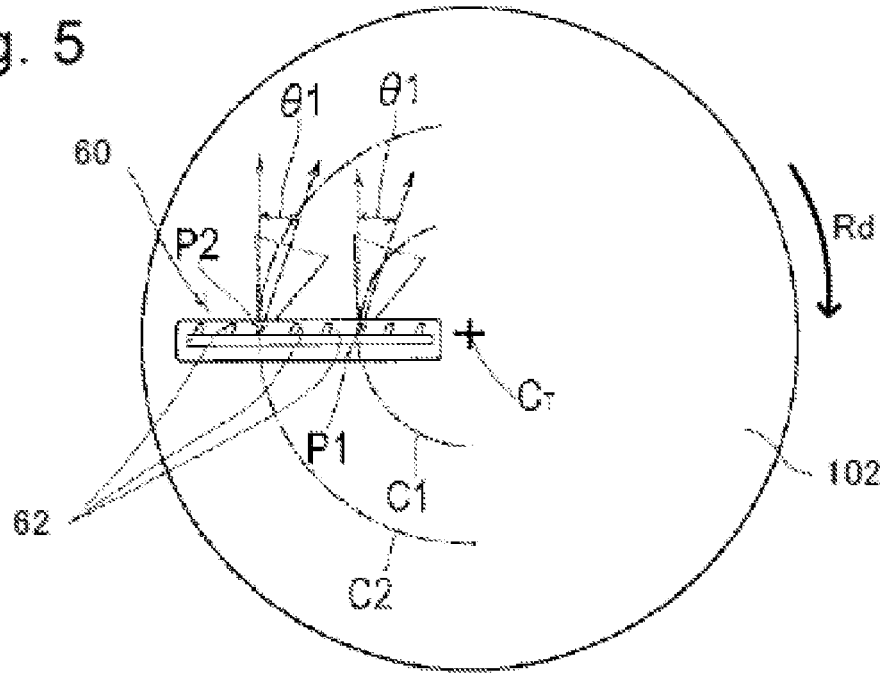
FIG. 5 is a plan view schematically showing gas injection nozzles of the temperature adjuster and a polishing pad.
Figure 6:
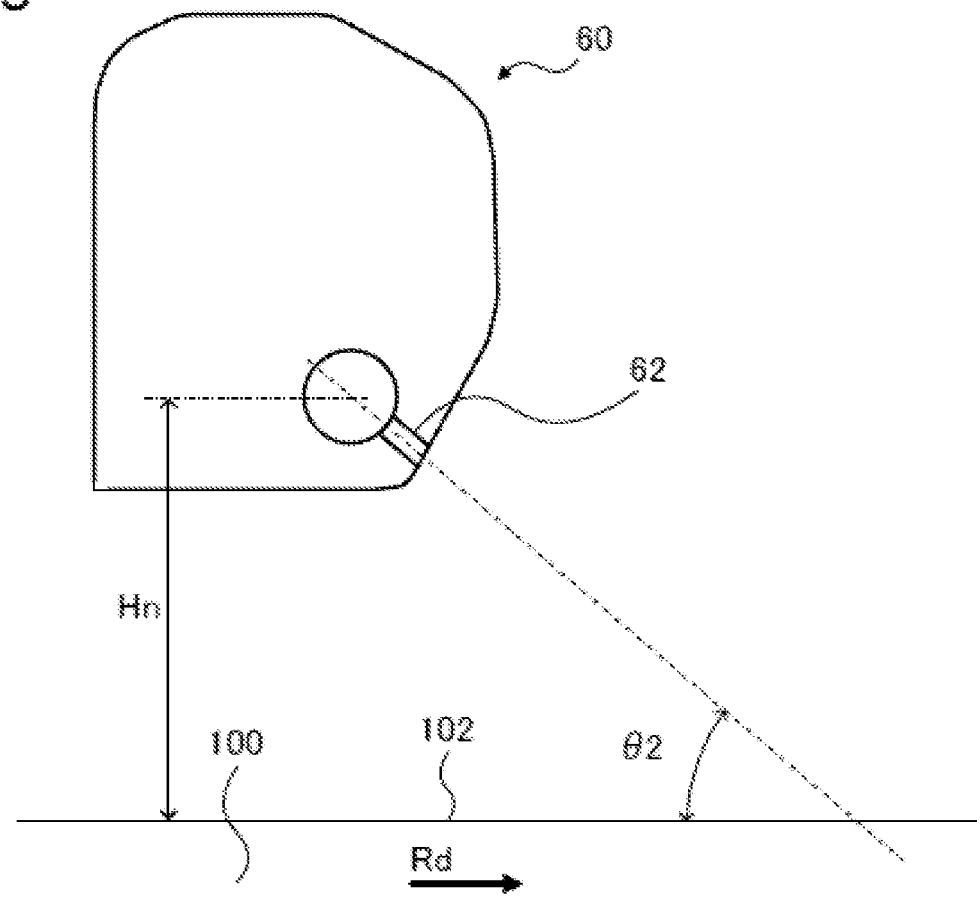
FIG. 6 is a side view schematically showing the gas injection nozzle of the temperature adjuster and the polishing pad.

FIG. 5 and FIG. 6 are a plan view and a side view schematically showing the gas injection nozzles 62 of the temperature adjuster60 and the polishing pad 100. As shown in FIG. 5, the temperature adjuster60 includes the plurality of gas injection nozzles 62 arranged at predetermined intervals along the radial direction of the polishing table 20 (eight nozzles are mounted in the illustrated example). In FIG. 5, the polishing pad 100 rotates in the clockwise direction Rd about the center CT of rotation during polishing. In this embodiment, the nozzles are numbered in ascending order of 1, 2, 3 . . . 8 from the inner side of the pad, and the description is made by taking two gas injection nozzles 62, for example, the third and sixth gas injection nozzles, as an example. That is, assume that concentric circles C1, C2 are drawn which respectively pass through points P1, P2 disposed directly below two gas injection nozzles 62, that is, the third and sixth gas injection nozzles, and have the center thereof at the center CT. Further, the tangential direction at the points P1, P2 on the concentric circles C1, C2 is defined as the rotation tangential direction of the polishing pad 100. On the above-mentioned assumption, the gas injection direction of each gas injection nozzle 62 is inclined toward the center of the pad by a predetermined angle (01) with respect to the rotation tangential direction of the polishing pad. The gas injection direction means the direction of a center line of the angle (gas injection angle) at which a gas spreads in a fan shape from a gas injection nozzle opening. In the same manner, nozzles other than the third and sixth nozzles are also inclined toward the center of the pad by a predetermined angle (01) with respect to the rotation tangential direction of the polishing pad. The angle (01) of the gas injection direction of the gas injection nozzle 62 with respect to the rotation tangential direction of the polishing pad is set to a value which falls within a range of from 15° to 35° due to the relationship with the temperature adjustment capability. In this embodiment, the case where eight nozzles are used has been described. However, the number of nozzles may be adjusted by closing a nozzle hole by a plug or the like so that a desired number of nozzles may be adopted. The appropriate number of nozzles is determined corresponding to a size and the like of the polishing pad 100.

As shown in FIG. 6, the gas injection direction of the gas injection nozzle 62 is not perpendicular to the surface (polishing surface) 102 of the polishing pad 100, but is inclined in the rotating direction Rd of the polishing table 20 by a predetermined angle. Assume that the angle of the gas injection direction of the gas injection nozzle 62 with respect to the polishing surface 102, that is, the angle made by the polishing surface 102 and the gas injection direction of the gas injection nozzle 62 is defined as a gas entry angle (θ2). On the above-mentioned assumption, the gas entry angle (θ2) is set to 30° to 50° due to the relationship with temperature adjustment capability. In this embodiment, the gas injection direction means the direction of a center line of the angle (gas injection angle) at which a gas spreads in a fan shape from the gas injection nozzle opening. As shown in FIG. 6, the gas injection nozzles 62 are configured to be movable in the vertical direction so that the height Hn of the gas injection nozzles 62 from the polishing surface 102 can be adjusted.

With the provision of such a temperature adjuster60, a gas is injected from at least one gas injection nozzle 62 toward the polishing pad 100 (polishing surface 102) during polishing of the substrate Wk so that a temperature of the polishing surface 102 can be adjusted. Further, the polishing liquid removing portion50 which removes a polishing liquid from the polishing surface 102 is disposed forward of the temperature adjuster60 in the rotating direction Rd of the polishing table 20. Accordingly, the temperature adjuster60 can adjusts a temperature of the polishing surface 102 in a state where the polishing liquid which may function as a heat-insulating layer is removed and hence, the efficiency of adjusting a temperature of the polishing surface 102 can be enhanced. Further, scattering of a polishing liquid can be reduced also when a gas is vigorously injected to the polishing surface 102 from the gas injection nozzles 62 of the temperature adjuster60 and hence, the formation of scratches on the substrate Wk can be suppressed. Moreover, in the polishing apparatus 10 of this embodiment, a polishing liquid used once in performing polishing of the substrate Wk is removed by the polishing liquid removing portion50, and a new polishing liquid is supplied to the polishing surface 102 from the polishing liquid supply nozzle 40 each time polishing is performed. Accordingly, constant quality of a polishing liquid used in performing polishing of the substrate Wk can be maintained.

(Modification 1)

Figure 7:
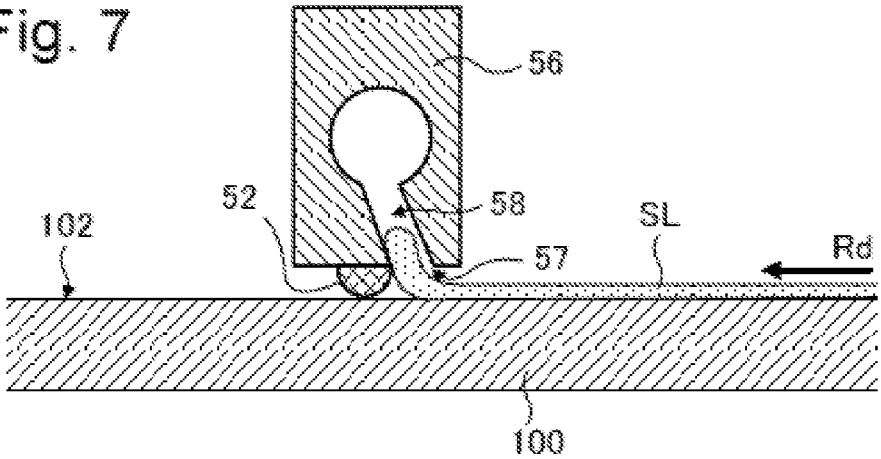
FIG. 7 is a view schematically showing one example of a polishing liquid removing portion in a modification.

FIG. 7 is a view schematically showing one example of a polishing liquid removing portion in a modification. In the above-mentioned embodiment, the slit 57 and the flow passage 58 of the suction portion 56 are formed to make an angle of 90 degrees with respect to the polishing surface 102. However, the configuration is not limited to such an example. As shown in FIG. 7, the slit 57 and the flow passage 58 of the suction portion 56 may be inclined such that an angle made with the rotating direction Rd of the polishing table 20 is set to 10 degrees or more and less than 90 degrees. With such a configuration, a polishing liquid SL can be guided to the flow passage 58 along with the rotation of the polishing table 20 so that the polishing liquid SL can be preferably sucked.

In the above-mentioned embodiment, the dam portion 52 of the suction portion 56 comes into contact with the polishing surface 102. However, the configuration is not limited to such an example. It is sufficient for the dam portion 52 to come into contact with the polishing liquid so that the dam portion 52 may be disposed with a gap formed between the dam portion 52 and the polishing surface 102. In this case, the dam portion 52 does not come into contact with the polishing surface 102 and hence, it is possible to prevent the generation of abraded debris of the dam portion 52 and the generation of a contact resistance. The polishing apparatus 10 may further include a sensor which detects the position of the polishing surface 102, or a distance between the polishing liquid removing portion50 and the polishing surface 102. In the polishing apparatus 10, the polishing liquid removing portion50 may be brought into contact with the polishing surface 102, or the distance between the polishing liquid removing portion50 and the polishing surface 102 may be held at a fixed distance based on the detected position or the detected distance.

In the above-mentioned embodiment, the polishing liquid removing portion50 includes the dam portion 52 and the suction portion 56 as an integral body. However, the configuration is not limited to such an example. The polishing liquid removing portion50 may include the dam portion 52 and the suction portion 56 separately, or may include only one of the dam portion 52 or the suction portion 56. At least a portion of the polishing liquid removing portion50 may be integrally formed with a dresser, an atomizer or the like which performs the conditioning of the polishing pad 100.

(Modification 2)

Figure 8:
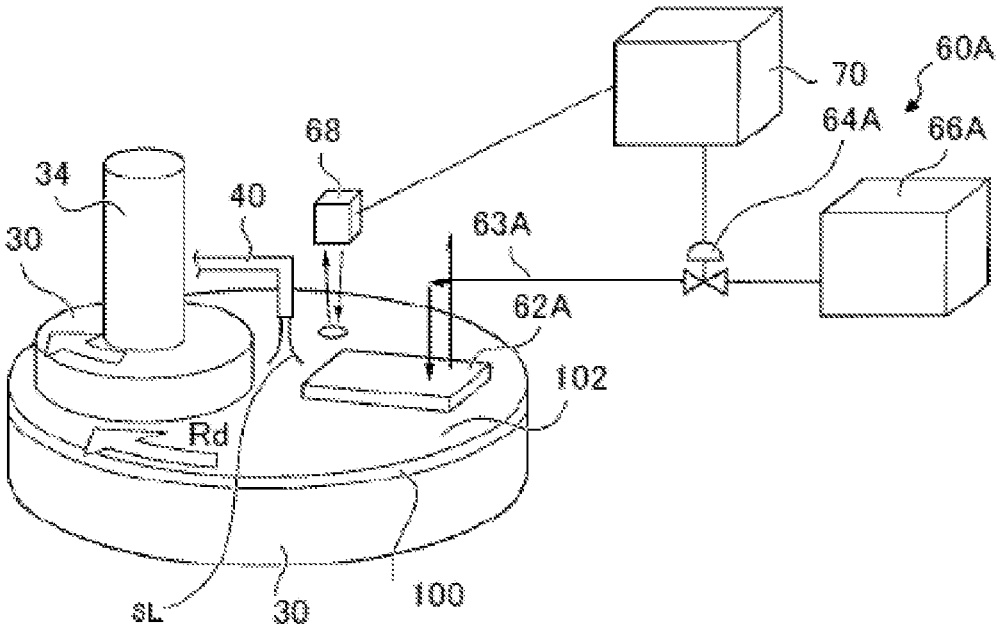
FIG. 8 is a view for describing the manner of the control of a temperature adjuster in the modification which is performed by a controller.

FIG. 8 is a view for describing the manner of the control of a temperature adjuster160 in a modification performed by a controller. The temperature adjuster 60 in the above-mentioned embodiment includes the gas injection nozzles (injectors) 62 which inject a gas toward the polishing surface 102. However, the temperature adjuster60 may include a heat exchanger in which a fluid flows instead of or in addition to the gas injection nozzles 62. As shown in FIG. 8, a temperature adjuster60A in the modification includes a heat exchanger 62A instead of the gas injection nozzles 62. The polishing apparatus of the modification shown in FIG. 8 is substantially equal to the polishing apparatus 10 of the embodiment except for the temperature adjuster60A. In FIG. 8, the illustration of the polishing liquid removing portion50 is omitted. As shown in FIG. 8, a flow passage not shown in the drawing is formed in the heat exchanger 62A, and the heat exchanger 62A is connected to a fluid supply source 66A by way of a pipe 63A. A pressure control valve 64A is provided to the pipe 63A. A fluid supplied from the fluid supply source 66A passes through the pressure control valve 64A so that pressure and a flow rate of the fluid are controlled. The pressure control valve 64A is connected to a controller70. For a fluid used in the heat exchanger 62A, a liquid such as water may be used, or a gas such as air may be used. A reaction gas may be made to flow in the heat exchanger 62A, and a catalyst which promotes an exothermic reaction of the reaction gas may be disposed in the heat exchanger 62A. The heat exchanger 62A may be disposed in a contact manner with the polishing surface 102, or may be disposed with a gap formed between the heat exchanger 62A and the polishing surface 102.

In the same manner as the above-mentioned embodiment, the controller70 adjusts a valve opening of the pressure control valve 64A based on a temperature detected by the temperature sensor 68 thus controlling a flow rate of a fluid flowing in the heat exchanger 62A. Also with the use of the temperature adjuster60A in the modification, in the same manner as the above-mentioned embodiment, a temperature of the polishing surface 102 can be adjusted. Further, the polishing liquid removing portion50 is disposed forward of the temperature adjuster60A in the rotating direction Rd of the polishing table 20. Accordingly, in the polishing apparatus of the modification, a temperature of the polishing surface 102 can be adjusted by the temperature adjuster60A in a state where a polishing liquid which may function as a heat-insulating layer is removed. Therefore, efficiency of adjusting a temperature of the polishing surface 102 can be enhanced.

The embodiment of the present invention has been described heretofore. However, the above-mentioned embodiment of the invention is provided for facilitating the understanding of the present invention, and does not limit the present invention. As a matter of course, without departing from the gist of the present invention, various modifications and variations of the present invention are conceivable, and the present invention includes a technique equivalent to the present invention. Within a range where at least a portion of the above-mentioned problem can be solved or within a range where at least a portion of the above-mentioned advantageous effects can be acquired, the embodiment and modifications may be desirably combined, and respective constitutional elements described in WHAT IS CLAIMED IS and the description may be desirably combined or omitted.

REFERENCE SIGNS LIST 10 polishing apparatus
20 polishing table
30 top ring
40 polishing liquid supply nozzle
50 polishing liquid removing portion
52 dam portion
56 suction portion
57 slit
58 flow passage
60, 60A temperature adjuster
62 gas injection nozzle
62A heat exchanger
70 controller
100 polishing pad
102 polishing surface
SL polishing liquid
Wk substrate

What is claimed is:

1. A polishing apparatus which performs polishing of an object to be polished using a polishing pad having a polishing surface, the polishing apparatus comprising:

a polishing table configured to rotate in a rotating direction, and to support the polishing pad;

a holder configured to hold the object to be polished, and to press the object to be polished against the polishing pad;

a polishing liquid supplying portion configured to supply a polishing liquid to the polishing surface; and a polishing liquid removing portion configured to remove the polishing liquid from the polishing surface, wherein the polishing table is configured to rotate with the polishing pad in a rotating direction, when polishing the object, the polishing liquid removing portion includes a suction portion having a slit and configured to suck the polishing liquid through the slit and a dam portion which comes into contact with the polishing liquid on the polishing surface thus preventing the polishing liquid from moving in the rotating direction, and in a longitudinal direction of the polishing liquid removing portion, the slit is formed with a length shorter than a length of the dam portion and longer than a diameter of the object held by the holder.

2. The polishing apparatus according to claim 1, further comprising a temperature adjuster configured to adjust a temperature of the polishing surface, wherein the temperature adjuster includes at least one of an injector which is configured to spray a gas to the polishing surface or a heat exchanger in which a fluid flows.

3. The polishing apparatus according to claim 1, wherein the polishing liquid supplying portion, a polishing region where the object to be polished is pressed against the polishing surface by the holder, and the polishing liquid removing portion are disposed in this order, in the rotating direction of the polishing table.

4. The polishing apparatus according to claim 1, wherein the dam portion is disposed rearward of the suction portion in the rotating direction, and is integrally formed with the suction portion.

5. The polishing apparatus according to claim 2 further comprising a temperature measuring portion configured to measure a temperature of the polishing surface, wherein the temperature adjuster is configured to adjust the temperature of the polishing surface such that the temperature measured by the temperature measuring portion reaches a target temperature.

6. The polishing apparatus according to claim 2, wherein the polishing liquid removing portion and the temperature adjuster are disposed adjacently to each other.

7. The polishing apparatus according to claim 1, wherein the slit is formed so as to define a flow path of the polishing liquid inclined with respect to the polishing surface.

8. The polishing apparatus according to claim 1, wherein the dam portion includes a rounded or chamfered portion which comes into contact with the polishing surface.

9. A polishing method of polishing an object, said polishing method comprising:

rotating an object;

polishing the object by pressing the object against a polishing surface of the polishing pad;

supplying a polishing liquid to the polishing surface of the polishing pad;

removing the polishing liquid from the polishing surface with a polishing liquid removing portion; and the polishing liquid removing portion includes a suction portion having a slit and configured to suck the polishing liquid through the slit and a dam portion which comes into contact with the polishing liquid on the polishing surface thus preventing the polishing liquid from moving in the rotating direction, and in a longitudinal direction of the polishing liquid removing portion, the slit is formed with a length shorter than a length of the dam portion and longer than a diameter of the object held by the holder.

* * * * *